3/22/88 XR 4,733,201

United States Patent [19]

Helszajn et al.

[11] Patent Number: 4,733,201

[45] Date of Patent: Mar. 22, 1988

[54] STACKED FERRITE RESONANCE ISOLATOR

[75] Inventors: Joseph Helszajn, Edinburgh, United Kingdom; William Thorpe, Cambridge, Canada

[73] Assignee: Com Dev Ltd., Cambridge, Canada

[21] Appl. No.: 840,689

[22] Filed: Mar. 18, 1986

[30] Foreign Application Priority Data

Oct. 16, 1985 [CA] Canada ..... 493084

[51] Int. Cl.[4] ..... H01P 1/365

[52] U.S. Cl. ..... 333/24.2; 333/248

[58] Field of Search ..... 333/24.2

[56] References Cited

U.S. PATENT DOCUMENTS 2,958,055 10/1960 Rowen ..... 333/24.2 X 3,063,028 11/1962 Weiss ..... 333/24.2

OTHER PUBLICATIONS

Beyer et al., *A New Fin-Line Ferrite Isolator for Integrated Millimeter-Wave Circuits*, IEEE, trans-on MTT, Dec. 1981, pp. 1344–1348.

*Primary Examiner*—Paul Gensler

*Attorney, Agent, or Firm*—Daryl W. Schnurr

[57] ABSTRACT

A fin-line resonance isolator has layers of hexagonal ferrite material that are stacked relative to one another so that the overall length of the isolator remains substantially constant as the number of layers of ferrite material increases. The isolator has substrate materials that are arranged so that the plane of circular polarization is shifted to a center of the isolator. Isolators of the present invention are capable of producing improved responses over prior art isolators while reducing insertion loss and achieving a weight and volume saving.

11 Claims, 5 Drawing Figures

LEGEND 10,12-FERRITE

16-METALIZATION

PRIOR ART

STACKED FERRITE RESONANCE ISOLATOR

BACKGROUND OF THE INVENTION

1. Field of the Invention

This invention relates to a resonance isolator having ferrite materials.

2. Description of the Prior Art

It is known to have resonance isolators that use hexagonal ferrites to separate forward and reverse waves in a plane of circular polarization. However, with previous devices, the physical length of the isolator is greatly increased as the number and size of ferrite materials increases. With previous isolators, the ferrite materials are cascaded (i.e. located side by side in the same plane) relative to one another. Some previous devices can have a cumbersome magnetic structure, or an arrangement of ferrite materials that is too large or an insertion loss that is much higher than necessary.

SUMMARY OF THE INVENTION

It is an object of the present invention to provide a resonance isolator that has a relatively small physical size and can produce similar results to prior art devices with a lower insertion loss.

In accordance with the present invention, a resonance isolator has a waveguide with dielectric substrate materials located within said waveguide to create a plane of circular polarization. There are means to apply a biasing magnetic field to said waveguide. The isolator has at least two layers of ferrite material that are stacked in contact with one another and mounted parallel to the plane of circular polarization and parallel to an E-plane of an electromagnetic field of the waveguide so that forward and reverse waves in, said plane of circular polarization can be separated.

At least two of the layers of ferrite material have dissimilar internal anistropy. Also, with previous isolators, the plane of circular polarization is often located approximately three-quarters of the way along the length of the isolator. The location of the plane in this position can make it necessary to increase the physical length of the isolator.

When isolators are used in the satellite communications industry, it is extremely important that the isolator have minimum weight and volume, while still being able to produce the desired results. Preferably, the layers of ferrite material all have the same size and shape and are stacked relative to one another so that edges of all layers are aligned.

Still more preferably, the substrate materials are arranged so that the plane of circular polarization is shifted towards a centre of the waveguide.

DESCRIPTION OF A PREFERRED EMBODIMENT

Figure 2:
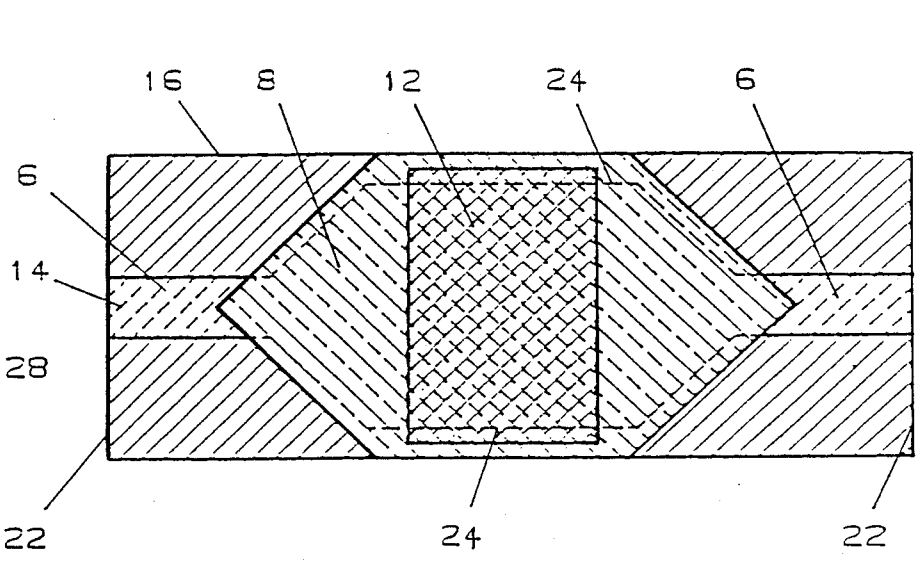
FIG. 2 is a side view of the resonance isolator of FIG. 1 with a portion of the waveguide removed to expose the ferrite material and layers of substrate material.
Figure 1:
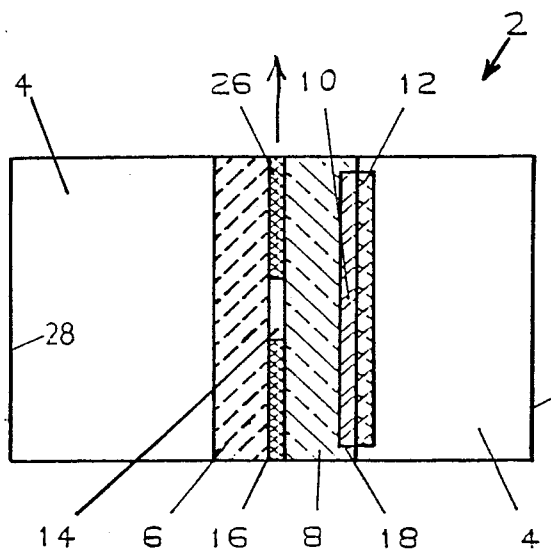
FIG. 1 is a sectional schematic end view of a resonance isolator having two stacked layers of ferrite material mounted in a waveguide.

Referring to the drawings in greater detail, in FIGS. 1 and 2, a resonance isolator 2 has a waveguide 4 with two layers 6, 8 of substrate materials located within said waveguide 4 to create a plane of circular polarization. Two layers 10, 12 of ferrite material are stacked relative to one another and mounted relative to said substrate materials in an electro-magnetic field of the waveguide 4 so that forward and reverse waves in said plane of circular polarization can be separated. The two layers 10, 12 of ferrite material both have the same size and shape and are stacked relative to one another so that the edges of all layers are aligned. This can best be seen from comparing FIGS. 1 and 2. In FIG. 2, the layer 10 of ferrite material cannot be seen as it is completely hidden from view by the layer 12 of ferrite material.

The substrate materials 6, 8 are arranged so that the plane of circular polarization is shifted towards a centre of the waveguide. The first layer of substrate material 6 is mounted transversed to an E-plane of the waveguide 4 and is separated from said second layer of substrate 8 by a gap 14. While the gap 14 could extend across a full width of the waveguide 4, it is preferable that a metallization layer 16 be located between the first and second substrate layers 6, 8, thereby reducing the size of the gap 14 to a band of the waveguide 4 in a longitudinal direction.

The ferrite material 10, 12 is affixed to a second layer 8 of substrate material on a side 18 of said second layer 8 of substrate material opposite to said first layer 6. For ease lf illustration, the thicknesses of the various layers of material shown in FIG. 1 are enlarged.

The first layer 6 of substrate material has a rectangular shape and the second layer 8 of substrate material has a hexagonal shape, said second layer having a maximum width substantially equal to a width of said first layer 6 and being symmetrical about said gap 14.

As best shown in FIG. 2, the gap 14 is a narrow band at either end 22 of the waveguide 4 but expands in an area betweeen said substrate layers 6, 8 to a hexagonal shape that corresponds to, but is slightly smaller than, the hexagonal shape of the second layer 8 of substrate material. The hexagonal shape of the gap 14 is indicated in FIG. 2 by dotted lines 24. The shape of the gap 14 confines the electric field of the substrate materials to a desired position within the waveguide 4. It can readily be seen that the interface 26 is located approximately in a centre of the waveguide 4 between two sides 28. In previous isolators, the natural plane of circular polarization is located approximately three-quarters of the distance across the waveguide 4 between the two sides 28. The shifting of the plane of circular polarization in the isolator in the present invention allows for much more space in which to locate the stacked ferrite materials than would be available in a prior art device.

The two layers 6, 8 of substrate material have a dissimilar permittivity and the plane of circular polarization is located along an interface 26 of the metallization layer 16 and the second substrate layer 8. Preferably, the first substrate layer 6 is a fin-line dielectric material and the metallization layer 16 is metal plating that is pre-etched so that it is clad to said first substrate layer 6.

The ferrite material 10, 12 is hexagonal ferrite material. While there are only two layers of ferrite material shown in the drawings, it will be readily apparent to those skilled in the art that any reasonable number of layers of ferrite material can be used to yield a particular response without any increase in physical length of the isolator. Generally, the greater the length of the isolator, the greater the insertion loss. Since the number of ferrite materials can be increased with the isolator of the present invention wihout any increase in the physical length of the isolator, the performance of the isolator can be improved without increasing the insertion loss.

In most uses of the isolator, the ferrite materials used will have a dissimilar internal anistropy to produce wide band performance of the isolator with a relatively small insertion loss. However, in some specific uses where insertion loss is relatively unimportant and it is desired to increase isolation, the layers of ferrite material can have a similar internal anistropy. The principles for designing an isolator in accordance with the present invention by choosing substrate materials of dissimilar permittivity and ferrite materials of either similar or dissimilar internal anistropy, depending on the desired result, are the same as the principles for designing prior art isolators and these principles are well known to those skilled in the art. Therefore, the particular design criteria are not outlined in this specification.

Figure 3:
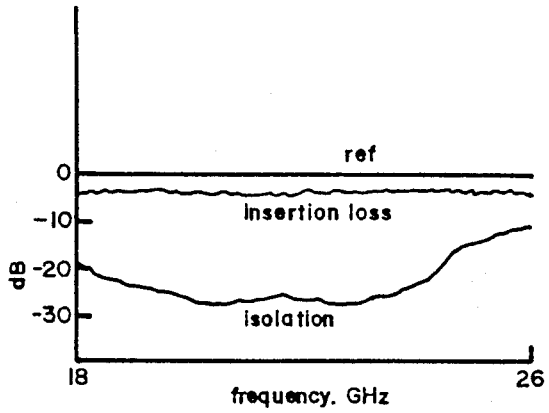
FIG. 3 is a graph showing the insertion loss and isolation of a prior art fin-line isolator using ferrite materials mounted in a cascade configuration.

Referring to FIG. 3 in greater detail, the insertion loss and isolation are shown for a prior art fin-line resonance isolator. The prior art isolator has two hexagonal ferrite materials with different internal fields, said ferrite materials being mounted in a cascade configuration. The actual ferrite materials used have specifications H200 and H220 respectively.

Figure 4:
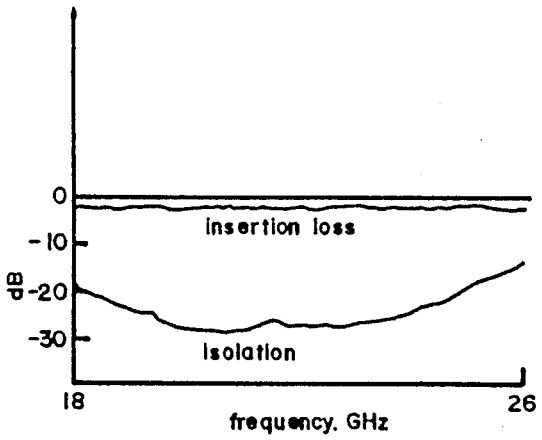
FIG. 4 is a graph showing the insertion loss and isolation of a fin-line isolator of the present invention using ferrite materials in a stacked configuration.

In FIG. 4, there is shown the insertion loss and isolation of a fin-line resonance isolator in accordance with the present invention. The isolator uses the same two hexagonal ferrite materials with different internal fields (i.e. H200 and H220) as those used in the prior art isolator described above in relation to FIG. 3. In the isolator of the present invention, the ferrite materials were mounted in a stacked configuration as opposed to the cascade configuration of the prior art isolator.

In comparing FIGS. 3 and 4, it can readily be seen that the isolation response shown in FIG. 4 is slightly better than the isolation response shown in FIG. 3. However, the insertion loss shown in FIG. 4 is approximately one-half of the insertion loss shown in FIG. 3. In other words, the isolator in accordance with the present invention has an improved isolation response over that of the prior art isolator and a much better insertion loss. In addition, the isolator constructed in accordance with the present invention has a waveguide with a length of 4 centimeters and a weight of 35 grams and the prior art isolator, used to produce the results shown in FIG. 3, has a length of 8 centimeters and a weight of 950 grams. The weight and volume savings of the isolator of the present invention will increase when compared to the prior art cascade isolators as the number of layers of ferrite material increases.

Figure 5:
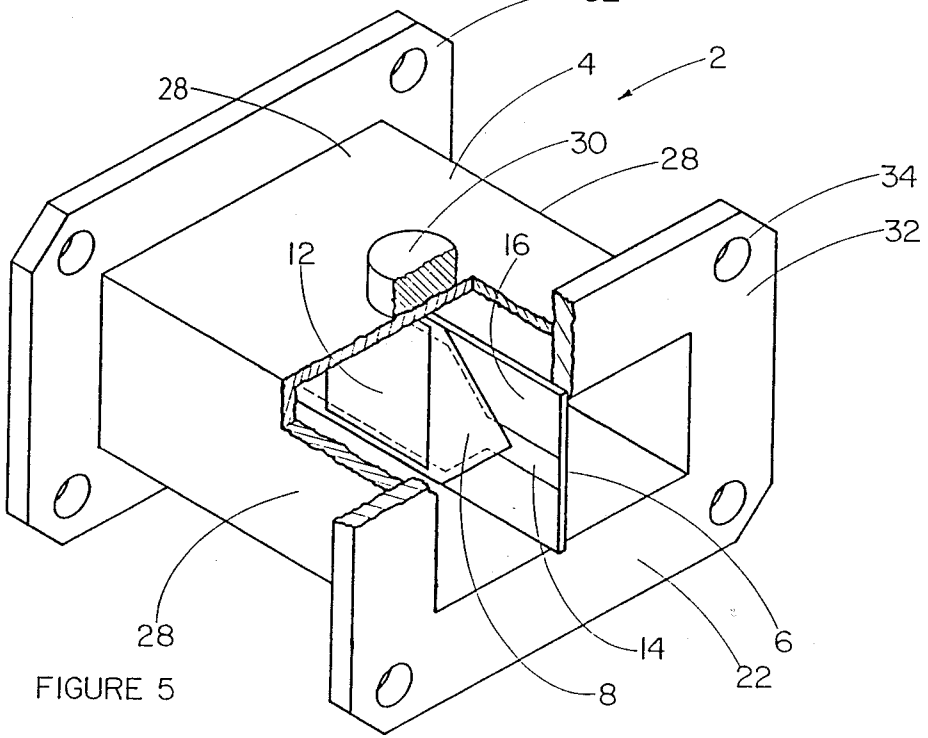
FIG. 5 is a partially cut-away perspective view of the resonance isolator.

In FIG. 5, the actual shape of the waveguide 4 and the orientation of the two layers of substrate materials, the two layers of hexagonal ferrite materials and the metallization layer with the gap is shown. As the various layer of materials are very thin, some layers cannot be distinguished from other layers. The waveguide 4 has four sides 2B. Two bias magnets 30 (only one of which is shown in FIG. 5) are located into opposing sides 28 of the waveguide 4 adjacent to an upper and lower edge of the ferrite materials. Flanges 32 with openings 34 are located at either end 22 of the waveguide 4. The arrangement of the magnets 30 and the shape of the waveguide 4 are conventional and are therefore not further discussed.

What we claim as our invention is:

1. A resonance isolator comprising a waveguide with dielectric substrate materials located within said waveguide to create a plane of circular polarization, with means to apply a biasing magnetic field to said waveguide, with at least two layers of ferrite material being stacked in contact with one another and mounted parallel to the plane of circular polarization and parallel to an E-plane of an electromagnetic field of the waveguide so that forward and reverse waves in said plane of circular polarization can be separated, at least two of the layers of ferrite material having dissimilar internal anistropy.

2. An isolator as claimed in claim 1 wherein the layers of ferrite material all have the same size and shape and are stacked relative to one another so that edges of all layers are aligned.

3. An isolator as claimed in claim 2 wherein the substrate materials are arranged so that the plane of circular polarization is shifted towards a centre of the waveguide.

4. An isolator as claimed in claim 3 wherein there are two layers of substrate material, the first layer being mounted parallel to the E-plane of the waveguide and the ferrite material being affixed to a second layer of substrate material on a side opposite to said first layer.

5. An isolator as claimed in claim 4 wherein said first layer of substrate material is separated from said second layer of substrate material by a gap.

6. An isolator as claimed in claim 5 wherein a metallization layer is located between the first and second substrate layers in said gap thereby reducing the size of the gap to a band along a centre of the waveguide in a longitudinal direction.

7. An isolator as claimed in claim 6 wherein the first layer of substrate has a rectangular shape and the second layer of substrate has a hexagonal shape, said second layer having a maximum width substantially equal to a width of said first layer of substrate and being symmetrical about said gap, said gap being a narrow band at either end of the waveguide but expanding in an area between said substrate layers to a hexagonal shape that corresponds to but is slightly smaller than the hexagonal shape of the second layer of substrate material.

8. An isolator as claimed in claim 7 wherein the two layers of substrate material have a dissimilar permittivity and the plane of circular polarization is located along an interface of the metallization layer and the second substrate layer.

9. An isolator as claimed in claim 8 wherein the first substrate layer is a fin-line dielectric material and the metallization layer is metal plating that is pre-etched on said first substrate layer.

10. An isolator as claimed in claimed in any one of claims 2, 6 or 9 wherein the ferrite material is hexagonal ferrite material.

11. An isolator as claimed in any one of claims 2, 6 or 9 wherein there are only two layers of ferrite materials.

* * * * *